US007758525B2

(12) United States Patent
Thiebaut et al.

(10) Patent No.: US 7,758,525 B2
(45) Date of Patent: Jul. 20, 2010

(54) MASSAGE AND/OR DISPENSING APPLIANCE

(75) Inventors: Laure Thiebaut, Clichy (FR); Philippe Bonneyrat, Herblay (FR)

(73) Assignee: L'Oreal, Paris (FR)

( * ) Notice: Subject to any disclaimer, the term of this patent is extended or adjusted under 35 U.S.C. 154(b) by 1042 days.

(21) Appl. No.: 11/446,121

(22) Filed: Jun. 5, 2006

(65) Prior Publication Data

US 2006/0276730 A1 Dec. 7, 2006

Related U.S. Application Data

(60) Provisional application No. 60/689,548, filed on Jun. 13, 2005.

(30) Foreign Application Priority Data

Jun. 3, 2005 (FR) ..... 05 51494

(51) Int. Cl.
*A61H 1/00* (2006.01)

(52) U.S. Cl. ..... 601/112; 601/17; 601/18

(58) Field of Classification Search ..... 601/15, 601/17, 18, 112, 114, 136–138, 154–167; 401/28, 265–266, 286–288; 15/22.1, 24, 15/29, 31, 97.1; 132/111, 114
See application file for complete search history.

(56) References Cited

U.S. PATENT DOCUMENTS

| | | | | |
|---|---|---|---|---|
| 3,981,597 A | | 9/1976 | Cohn | |
| 3,994,290 A | | 11/1976 | Springer et al. | |
| 4,189,801 A | * | 2/1980 | Lanusse | 15/22.1 |
| 4,492,223 A | | 1/1985 | Burke | |
| 5,423,102 A | * | 6/1995 | Madison | 15/22.2 |
| 5,680,666 A | * | 10/1997 | Ra | 15/97.2 |
| 5,700,146 A | * | 12/1997 | Kucar | 433/82 |
| 6,292,971 B1 | * | 9/2001 | Chaudray | 15/29 |
| 6,527,150 B2 | * | 3/2003 | Benoist | 222/402.1 |
| 7,114,211 B2 | * | 10/2006 | Elster | 15/24 |

FOREIGN PATENT DOCUMENTS

| | | |
|---|---|---|
| BE | 891 197 | 3/1982 |
| FR | 2 674 183 | 9/1992 |
| FR | 2 811 872 | 1/2002 |
| FR | 2 841 159 | 12/2003 |
| WO | 97/22326 | 6/1997 |

OTHER PUBLICATIONS

U.S. Appl. No. 11/446,297, filed Jun. 5, 2006, Thiebaut et al.

* cited by examiner

*Primary Examiner*—Quang D Thanh
(74) *Attorney, Agent, or Firm*—Oblon, Spivak, McClelland, Maier & Neustadt, L.L.P.

(57) ABSTRACT

An appliance or device for massaging and/or dispensing a product. The device includes a container holding the product, preferably a cosmetic product, a housing to which the container is mounted, and a massage element mounted on the housing. A rotary drive arrangement rotates the massage elements about an axis of rotation relative to the housing. In addition, a conduit is in fluid communication between an outlet from the container and the massaging element. The container has an axis between the outlet and a bottom of the container, with this axis is parallel to the axis of rotation.

32 Claims, 3 Drawing Sheets

-1-

MASSAGE AND/OR DISPENSING APPLIANCE

CROSS-REFERENCE TO RELATED APPLICATIONS

This document claims priority to French Application Number 05 51494, filed Jun. 3, 2005 and U.S. Provisional Application No. 60/689,548, filed Jun. 13, 2005, the entire contents of which are hereby incorporated by reference.

FIELD OF THE INVENTION

The invention provides an appliance or device for massaging and/or dispensing a cosmetic product held in a container mounted on a housing of the appliance. Preferably, the massaging action is obtained by causing the massage element of this appliance to rotate.

BACKGROUND OF THE INVENTION

Discussion of Background

The expression "cosmetic product" is understood to mean a product as defined in EC Council Directive 93/35/CEE dated 14 Jun. 1993.

U.S. Pat. No. 3,994,290 describes a known massage device including a rotary massage unit caused to rotate by a motor and carrying a plurality of balls mounted freely thereon. The massage device is mounted on a housing also accommodating a container holding a product capable of being distributed to the balls via a channel. The container includes a one-way duck-bill valve which can only be opened in response to a partial vacuum created in a chamber in the housing attached to this valve. Such a partial vacuum can be obtained in the chamber by virtue of the relative size and shape of the chamber and the channel in communication therewith, in particular when the container returns from a partially depressed position in said chamber to its initial position.

Patent application WO 97/22326 describes a massage device including a handle at one end of which is mounted a part that is rotatably movable relative to the handle. The movable part includes a product reservoir of which one wall forms a massaging surface. The wall includes balls mounted freely in rotation which communicate both with the inside of the reservoir and with the massaging surface so as to convey the product from the reservoir to the surface. The reservoir is therefore coupled to the massaging surface so that when the massaging surface is caused to rotate, the reservoir containing the product also rotates. Also, when the massaging surface is applied to the skin, the product is transferred by the balls onto the skin. This device does not permit the massaging action only to be effected without applying product.

A problem posed by the massage devices in the current art lies in the fact that they are not easy to grasp, nor is it easy to selectively dispense product or control the rotation of the massaging element.

Moreover, the device described in patent application WO 97/22326 does not allow the product reservoir and the massaging element to be changed independently.

SUMMARY OF THE INVENTION

With the foregoing in mind, the invention provides an appliance or device for massaging and/or dispensing a product. According to a preferred example, the device includes a container holding the product, preferably a cosmetic product.

A housing is mounted to the container and a massage element is mounted on this housing. A rotary driving arrangement rotates the massage element about an axis of rotation relative to the housing and the container, and a conduit is in fluid communication between an outlet from the container and the massage element. In addition, the container includes an axis extending between the outlet and a bottom of the container, with this axis being parallel to the axis of rotation.

Another problem posed by the massage devices of the current art lies in the fact they fail to provide reliable and easy-to-use solutions for dispensing a product simultaneously with or independently of the massaging action. Moreover, with the devices of the current art the dispensing of product is uncertain when the container is no longer completely full.

Advantageously, the container is preferably configured for the packaging and dispensing of a product under pressure, with the conduit being connected to an outlet of a dispensing valve on the container.

The container can be arranged relative to the housing so as to form a grasping element for the appliance. A closed bottom of the container, opposite the dispensing valve, can then form a grasping element.

By way of example, an actuating element of the valve can project beyond the external outline of the housing. This actuating element can include a lever arm. For example, actuation of the valve can be obtained by pushing down the valve stem. Alternatively and/or in addition, the valve can be actuated by inclining or tilting the valve stem.

For example, the conduit can include a section parallel to the axis of rotation, for example, with a section having an axis substantially coincident with the axis of rotation. As the massage element rotates, this conduit section can remain fixed, which limits problems of dynamic sealing. The container can include a principal lengthwise axis parallel to the axis of rotation of the massage element. For example, the container can be mounted on the housing at a first end axially opposite, relative to the axis of rotation of the massage element, a second end of the housing to which the massage element is mounted.

Advantageously, the container can be detachably mounted on the housing. The container can be held in place, for example, by snapping into a cavity of the housing.

The container can include a wall delineating therein a compartment containing a product to be sprayed and a gas under pressure which are at least partially mixed.

Alternatively, the container can include two compartments of variable volume, with a first compartment in communication with the valve and containing the product to be sprayed and with a second compartment containing a propellant. Preferably the wall is impermeable to the product and the propellant.

By way of example, the massage element can advantageously be detachably mounted on the housing. The massage element can have an application surface with at least one projection, for example an off-center projection, or a plurality of projections of different shapes and different heights.

Also by way of example, the massage element can include a detachable head providing the application surface. The user can thus obtain different applications in relation to the chosen massage element. For example, the massage element can include a foam pad when the massage is intended to produce a contouring effect for example. According to another example, the massage element can include a tuft of bristles when the massage is intended for example to replace the brush required to spread shaving foam, or to cleanse the skin. According to another example, the massage element can include an abrasive application surface, for example obtained by incorporating particles of aluminium oxide in a resin or foam, when micro-dermabrasion of the outer layers of the epidermis or "peeling" is wanted.

The massage element can also include a structure holding freely rotatable balls seated in recesses in the massage element.

Further by way of example, the massage element can include a resiliently deformable portion, for example made of a closed-cell foam or an elastomer material to accommodate the surface differences of the areas of the body to be massaged.

The application surface of the massage element can have a symmetry of revolution substantially about an axis of symmetry, the application surface being caused to rotate by the driving means about the axis of symmetry.

The driving arrangement can include a motor powered for example by a battery, for example a cell accommodated in the housing, or by an external power source, operated by a control device. The motor can rotatably drive the applicator element directly or indirectly, for example via transmission elements, so as to reduce the speed of rotation and increase the torque for example.

The invention also provides a massaging element designed to be rotatably and detachably mounted on a housing of an appliance or device according to the invention.

According to further object of the invention, a kit or assembly is provided which includes an appliance according to the invention and a plurality of containers. These containers can be selectively and detachably mounted on the housing of the appliance. In such a kit, the containers preferably hold different products.

The kit or assembly can include a plurality of massage elements, which can be selectively and detachably mounted on the housing of the appliance. Thus, for example depending on the desired massage effect, the user selects the massage element having the appropriate surface projections to obtain this massaging effect. In such a kit, the massage elements preferably have different surface projections.

The invention also provides a cosmetic and non-therapeutic method of applying a product on a surface of the body. A preferred example of the method includes providing a kit or assembly as described above, selecting a container, and mounting the selected container on the appliance housing. A product is applied onto the body, and the area of the body onto which the product has been applied is massaged with the massage element driven in rotation.

In such a method, the user preferably selects a massage element to mount on the appliance housing in relation to the container selected.

As should be apparent, the invention can provide a number of advantageous features and benefits. It is to be understood that, in practicing the invention, an embodiment can be constructed to include one or more features or benefits of embodiments disclosed herein but not others. Accordingly, it is to be understood that the preferred embodiments discussed herein are provided as examples and are not to be construed as limiting, particularly since embodiments can be formed to practice the invention that do not include each of the features of the disclosed examples.

BRIEF DESCRIPTION OF THE DRAWINGS

The invention will be better understood by reading the following description and by reference to the accompanying figures. These are given for guidance only and are in no way limitative of the invention. In the drawings.

DETAILED DESCRIPTION OF THE PREFERRED EMBODIMENTS

Figure 1:
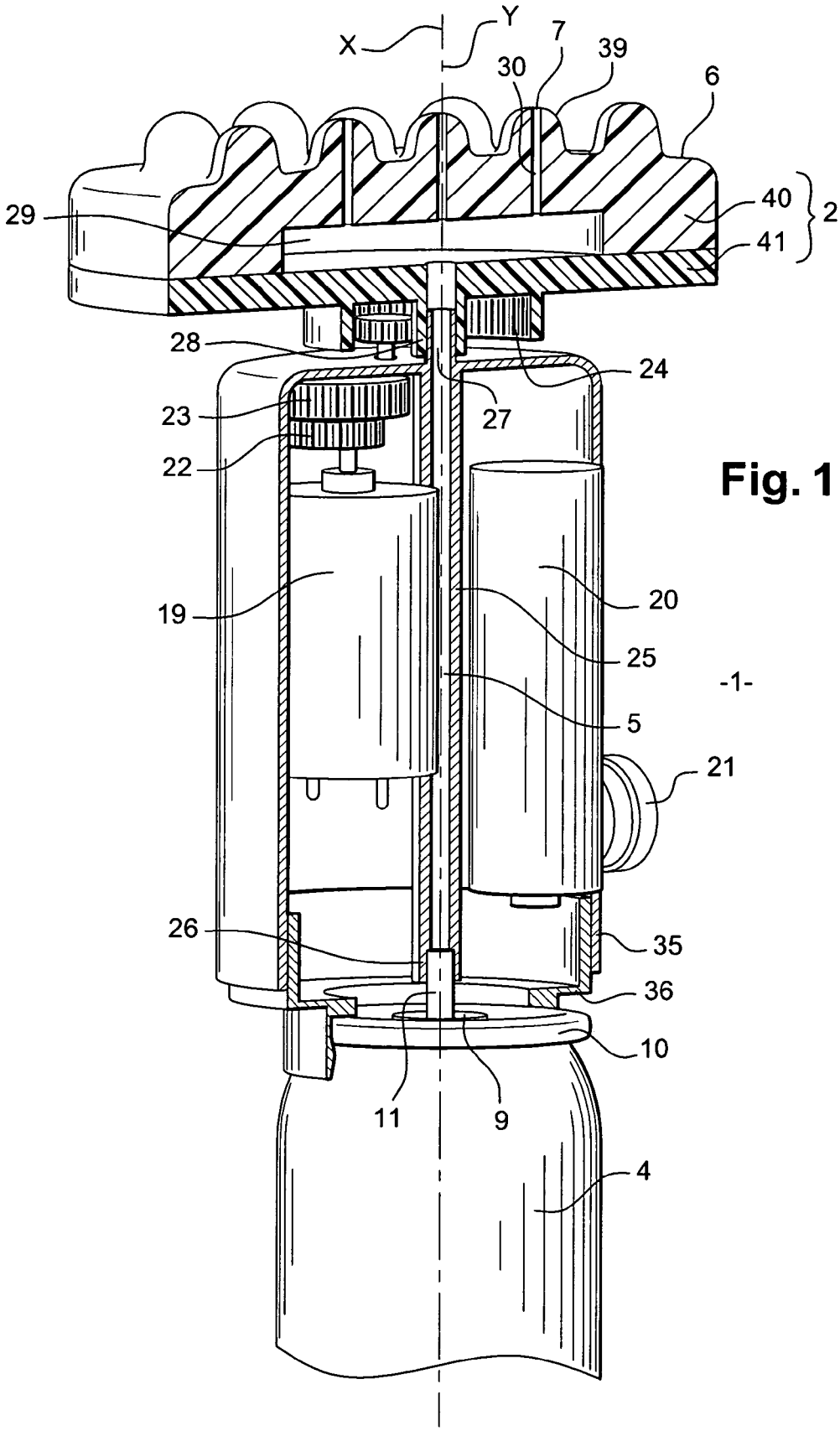
FIG. 1 is a partially truncated profile view of an appliance or device according to the invention.

FIG. 1 shows an appliance or device 1 according to an example of the invention. In the illustrated example, a massage element 2 is detached from a housing 3 to which a container 4 is mounted. The container 4 dispenses the product P contained therein through the massage element 2 via at least one conduit 5 emerging at or in communication with an application surface 6 of the massage element 2 through at least one outlet aperture 7 of the massaging element 2.

The container 4 is preferably designed to contain and to dispense under pressure a product P, for example in liquid or paste form. The container 4 is said to be an "aerosol." Such a container 4 serves to propel the product P into the conduit or channel 5 and through the massage element 2.

The container 4 in the illustrated example includes an outer rigid chamber 8, preferably made of metal or plastic. It also includes a dispensing valve 9 generally mounted on a cup 10 held in place, for example by flare fitting or rolling, on the outer chamber 8. The container 4 enables the product P to be dispensed, for example, continuously, at a continuous rate of flow, during the phase where the valve 9 is held open.

The chamber 8 can contain the product and the propellant gas. By way of example, to dispense the product, when the stem 11 of the dispensing valve 9 is actuated, the valve 9 is continuously supplied with product, for example by an immersion tube, if the density of the product to be dispensed is greater than that of the propellant gas and if the container is presented "upright," i.e. with the valve 9 above the chamber 8.

Figure 2:
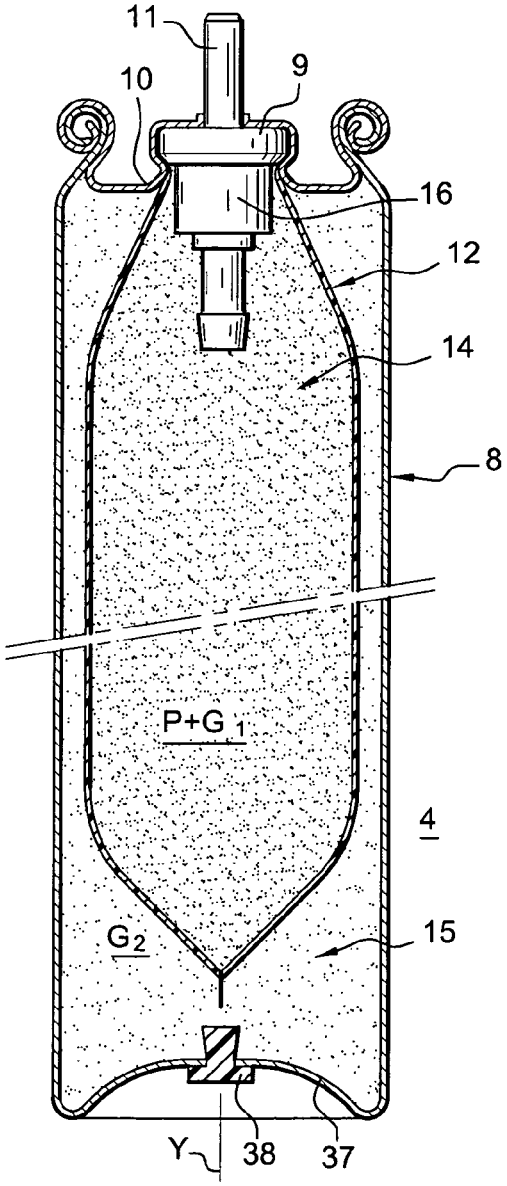
FIGS. 2 and 3 are lengthwise sectional views of containers configured to be mounted in an appliance according to the invention.
Figure 3:
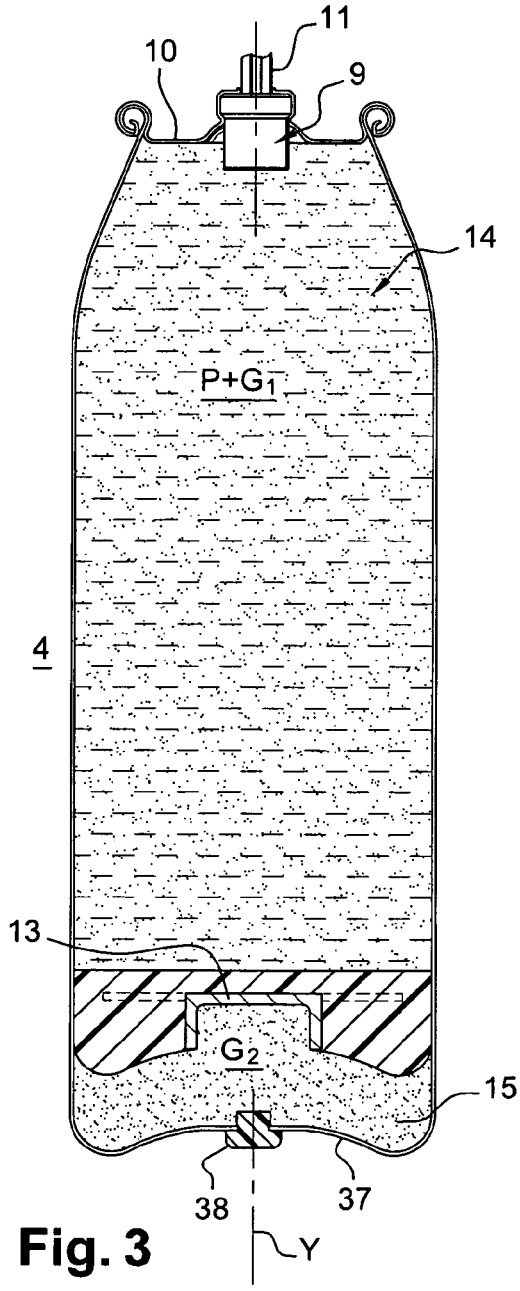

For example, in order to dispense the product in any position, the product P to be dispensed and the propellant gas can be packaged separately in the chamber 8 as shown in FIGS. 2 and 3. The container 4 can be of the type taught in document FR-2841159, for example.

To do this, as shown in FIG. 2, the product can be packaged in a flexible-wall pocket 12 in communication with the dispensing valve 9. A propellant G2 is packaged in a volume formed between the external surface of the pocket 12 and the inner wall of the outer chamber 8. In this example, the internal volume of the pocket 12 defines a first compartment 14 and the volume of the chamber 8 outside the pocket 12 defines a second compartment 15.

Alternatively, as shown in FIG. 3, the product P is kept separate from the propellant gas G2 by a piston 13 designed to slide in leaktight bearing contact against the inner surface of the outer chamber 8 so that the container 4 is separated into two compartments, with a first compartment 14 in communication with the dispensing valve 9, containing the product P, and with a second compartment 15 between the piston 13 and the bottom of the container, holding the propellant gas G2.

To dispense the product with such devices, the dispensing valve 9 can be open by depressing and/or by tilting the stem 11 projecting beyond the body 16 of the valve 9. The body 16 of the valve 9 is in a fixed axial position relative to the outer chamber 8 by virtue of the fact that it is held in place in the cup 10, for example by crimping, with the cup 10 also being in a fixed axial position relative to the chamber 8.

When the dispensing valve 9 is opened, the pressure exerted by the propellant agent G2 on the pocket 12 or the piston 13 acts upon and expels the product P from the pocket or the first compartment via the dispensing valve 9.

By way of example, the product P can then be dispensed in paste form, in particular a cream or gel, in liquid form, spray form, or in the form of a foam.

In the first compartment 14 or internal volume of the pocket 12, the product P to be sprayed can be mixed with a first propellant G1 or a high vapour pressure solvent, while the second compartment 15 contains the second propellant G2, with the wall of the pocket 12 or of the piston 13 preferably being impermeable to the product and to the propellants.

The first propellant G1 is chosen for example from hydrocarbons or dimethylether, alone or mixed. The second propellant G2 is, for example, a compressed or liquefied gas, for example a mixture of propane, butane and isobutane, or compressed air.

Also by way of example, the pocket 12 can be made of a metal-plastic composite, such as an aluminium-plastic composite including a layer of aluminium and at least one layer of a thermoplastic material, for example a polyamide, a polyethylene, a polyethylene terephthalate or a polypropylene.

The container 4 is designed to be detachably mounted in the housing 3. It is designed, for example, to be held in place by clamping or snap-on attachment with a counterpart arrangement provided on the inner surface of a cavity 17 formed in the housing 3. For example, a snap-on arrangement of the cavity can cooperate with an annular bead formed by the junction between the cup 10 and the outer chamber 8.

The massage element 2 forms a head 40 presenting the application surface 6, with this head 40 being held in place on a support 41. The head 40 can be detachable relative to the support 41 and held in place on this support 41, for example, by a bayonet type mount. Alternatively, the head 40 can be held in place, for example, by a snap-on attachment onto the support 41. In FIG. 1, the head 40 is integral with the support 41, for example by gluing or heat welding.

The massage element 2 is designed to be driven in rotation relative to the housing 3 by a driving arrangement provided inside the housing 3. In the illustrated example, the driving arrangement includes a motor 19 powered by a battery 20, with the battery 20 being connected to a control device 21 designed to selectively switch the power supply to the motor 19 on or off, and thereby to start or stop the rotation of the massage element 2. The battery 20 is, for example, formed by at least one cell, or several cells, accommodated in the housing 3. Alternatively, the motor 19 can be powered by an external power supply, for example using a cord and plug to connect the device to an electrical outlet.

The control device 21 can facilitate selection of different rotational speeds of the motor 19. The control device 21 can form an electrical switch fitted with a rotary selector projecting from the housing 3, for example so that it can be placed respectively in three positions: a first "off" position, a second position corresponding to a first rotational speed, and a third position corresponding to a second rotational speed. For example, the control device 21 can include a continuously variable speed drive to regulate the rotational speed of the motor 19 to obtain finer control of the massaging action desired, and in particular depending on the massaging element 2 fitted and/or the surface of skin to be massaged.

In the illustrated example, the motor 19 rotationally drives a toothed wheel or gear 22 cooperating with a set of gears 23 transmitting the movement to the massage element 2. In effect, the massage element 2, and more particularly the support 41, includes a toothed surface (not shown) engaging with one of the gears of the gear system 23. The gear system 23 forms an arrangement which reduces the rotational speed of the massaging element, with this reducing gear 23 making it possible to increase the torque.

The toothed surface is annular and traversed through its center by the channel 5. The channel 5 is partly formed inside a tube 25, disposed in the housing 3, a first end 26 of which is connected to the end of the valve stem 11 through which the product P is dispensed. At a second end 27, the tube 25 is in engagement with a mounting skirt (not shown) of the massage element 2, and more particularly of the support 41. This mounting skirt is inside and concentric with the toothed surface, and is in fluid communication with the outlet aperture 7. In the example illustrated, the mounting skirt emerges into an internal space 29 of the massaging element 2, this internal space 29 being, for example, formed between the support 41 and the head 40, so that the application surface 6 is traversed by at least one feeder channel 30 connecting the internal space 29 to the outlet aperture 7. As shown in FIG. 1, the application surface 6 is traversed by a plurality of feeder channels such as 30 emerging into the internal space 29 on one hand, and by a corresponding number of outlet apertures such as 7 on the other hand.

The axis X about which the massage element 2 is rotationally driven preferably corresponds to the axis of symmetry of revolution of the inner surface of the mounting skirt and the outer circumference of the tube portion 25 situated between the ends 26 and 27. Between the ends 26 and 27, the channel 5 forms a first section extending on the axis of rotation X.

In the illustrated example, when the massage element 2 is driven to rotate the mounting skirt is driven to rotate relative to the tube 25, and the tube 25 remains rotationally immobile relative to the housing 3. To this end, an annular ring can be provided between the tube 25 and the mounting skirt to maintain the leaktightness of this connection even when one is driven rotationally relative to the other.

In a variant not shown, the tube 25 can be flexible so as to be able, if necessary, to pass around components provided in the housing 3.

The appliance or device 1 is designed so that dispensing of the product P can be obtained independently of the rotationally driven action of the massage element 2. In the appliance 1 according to the invention, the axes X and Y are mutually parallel. The container 4 is then held in place at an end of the housing 3 axially opposite the end at which the massaging element 2 is mounted. In this example, actuation of the valve 9 is obtained by pressing downward, and this downward movement is obtained in particular by relative movement of the container 4 in relation to the housing 3, insofar as the tube 25 in this instance is in a fixed axial position inside the housing 3.

To dispense the product with such an appliance or device 1, the user grasps the outer surface of the housing 3 with one hand and the outer surface of the container 4 with the other hand, and pushes them together. Alternatively, the user can apply the application surface 6 against an area of the skin to be treated and then, depending on the grasping zone chosen, he/she can selectively dispense product or otherwise. In operation, if the user grasps the outer surface of the housing 3 when the application surface 6 is applied against the skin, the container 4 then remains in a fixed axial position relative to the housing 3, and the valve 9 remains closed. There is no dispensing of product.

However, if the user grasps the outer surface of the container 4, the container 4 can be depressed partially into the cavity 17 of the housing 3, and the valve 9 can be caused to open allowing the product to be dispensed, in relation to the force with which the application surface 6 of the appliance 1 is applied against the skin.

When the user grasps the container 4 by its outer surface projecting beyond the housing 3, and to ensure that only a translational movement of the container 4 relative to the housing 3 is permitted, in the illustrated example the container 4 is fitted with a collar 36 to guide and optionally limit the movement of the container 4 relative to the housing 3. This collar 36 cooperates with the sidewall 35.

The sidewall 35 of the container 4 is preferably cylindrical, with the container 4 including a bottom 37 axially opposed, relative to the axis Y, to the cup 10 carrying the valve 9. The bottom 37 is closed, and optionally includes a plug 38 to facilitate pressurisation of the second compartment 15 when the propellant G2 is injected, for example, via a syringe or needle through this plug 38, as shown in FIGS. 2 and 3.

In the illustrated examples of the invention, the bottom 37 and at least one portion of the sidewall 35 project beyond the housing 3. For example, the portion of the sidewall 35 projecting beyond the housing 3 accounts for more than half of the sidewall 35 relative to the principal lengthwise axis Y. Thus, the bottom 37 and the portion of the sidewall 35 form a location or region for grasping the appliance 1.

In addition, this visible portion of the container 4, not concealed by the housing 3, when the container 4 is mounted in the housing 3, enables the user to peruse information relating to the product and/or recommended instructions for use which may be inscribed on the sidewall 35.

Figure 4:
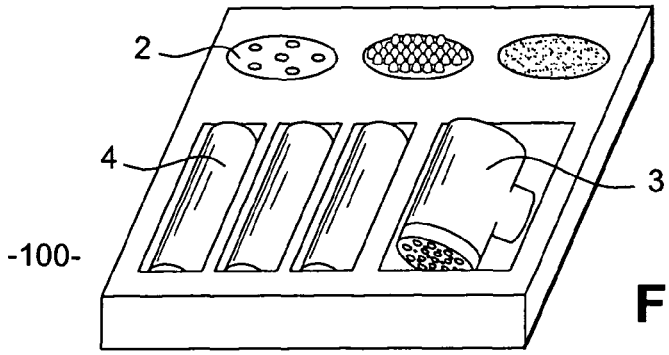
FIG. 4 is a perspective view of a kit or assembly according to the invention.

According to a preferred example of a method of using this appliance 1 when the appliance 1 is not fully assembled and ready to use, in particular when it is supplied in the form of a kit or assembly 100, as shown in FIG. 4, an assembly can be provided which optionally includes several massage elements such as 2 having different application surfaces capable of being selectively and detachably mounted on the housing 3. In addition, the kit or assembly preferably includes several containers such as 4, preferably holding different products, with these containers being capable of selective and detachable mounting on the housing 3.

By way of example, a method of applying a product on a surface of the body to be treated by means of said appliance 1 can include selecting a massage element such as 2 according to the product held in the container 4 that has been selected, mounting this massage element on the housing 3 and moving the valve 9 to the open position so that the product is dispensed at the application surface 6 so as to be applied on the body. Then, simultaneously or otherwise with the dispensing of the product, the user can massage the area of the body where the product has been applied using the rotationally driven massage element.

In particular, the massage elements designed to be mounted on the housing 3 so as to be rotationally driven, can have different application surfaces such as 6. They can present projections and/or a surface texture enabling the user to massage and/or cleanse the skin.

The application surfaces such as 6 of the massage elements can include, for example, natural or synthetic fibres (woven, non-woven, wadding), natural or synthetic sponge, or can be made of several materials. The massage elements can also be impregnated with a second product, for example having antibacterial or coloring properties.

In the example shown, the application surface 6 is formed from a block of thermo compressed foam optionally covered with a textile, presenting projections 39 disposed in a regular manner over the entire application surface 6. In particular, they are arranged in two circular concentric lines $L_e$ and $L_i$ centred on the axis of rotation X. Such an applicator element is obtained for example in accordance with the teaching of patents FR-2 674 183 and FR-2 811 872. Some of the projections can be traversed by a channel such as 30. Particularly in cases where the application surface 6 is supplied by several channels such as 30, the channels may also emerge at a distance from the projections such as 39. In this example, the projections such as 39 form dome-shaped bosses.

According to an example, the application surface 6 of the massage element can have a symmetry of revolution substantially about an axis of symmetry superimposable on the axis of rotation X.

Figure 5A:
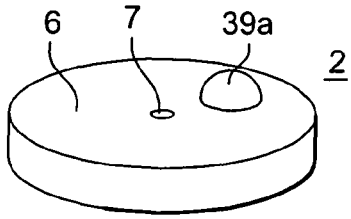
FIGS. 5*a* to 5*e* are views of different application surfaces of massage elements which can be mounted in an appliance according to the invention.

As a variant, the application surface 6 can have a single projection such as 39*a* placed off-center relative to the axis of rotation X when the massage element 2 is mounted on the housing 3, FIG. 5*a*.

Figure 5B:
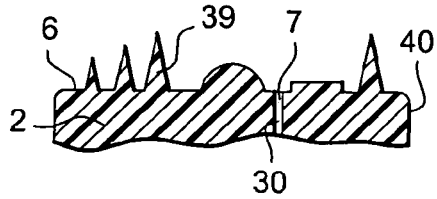

As another variant or example, the application surface 6 includes a plurality of projections such as 39 of different shapes and different heights, as shown in FIG. 5*b*.

Figure 5C:
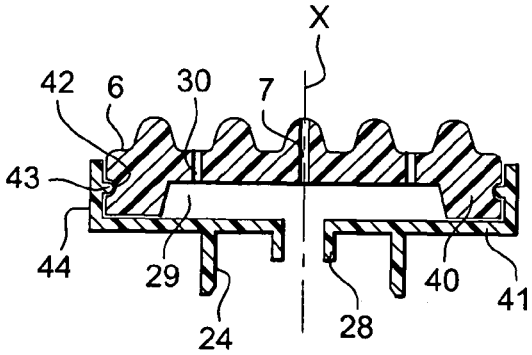

In FIG. 5*c*, the application surface 6 can be provided on the head 40 detachable from the support 41 designed to be retained on the housing 3, with the support 41 and the head 40 together forming the massage element 2 capable of being rotationally driven. Heads such as 40 designed to be mounted on the support 41 can respectively have different application surfaces. In this example, the head 40 includes a groove 42 designed to engage by snap attachment with a groove 43 on an inner surface of a skirt 44 of the support 41. The skirt 44 extends in a direction opposite the mounting skirt.

This head 40 can be made, for example, of foam, or a resiliently deformable material, in particular an elastomer, for example a PVC, PU, EVA, Nitrile, Silicone, Butyl, SIS, SEBS, EPDM, etc.

Preferably, the application surface 6 includes a resiliently deformable portion, for example made of an elastomer, to impart a feeling of comfort when applied on the skin. Also by way of example, the surface can be made at least partially of resiliently deformable material such as PVC, PU, EVA, Nitrile, Silicone, Butyl, SIS, SEBS, EPDM, etc.

Figure 5D:
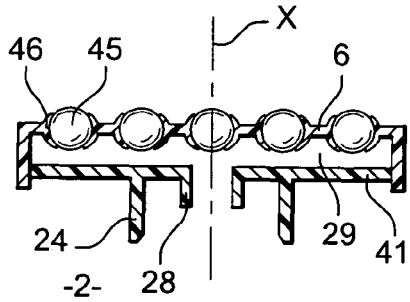

As a variant, shown in FIG. 5*d*, the massage element 2 can include a structure holding freely rotatable balls 45 each respectively seated in recesses 46 on the application surface 6 of the massage element 2.

Figure 5E:
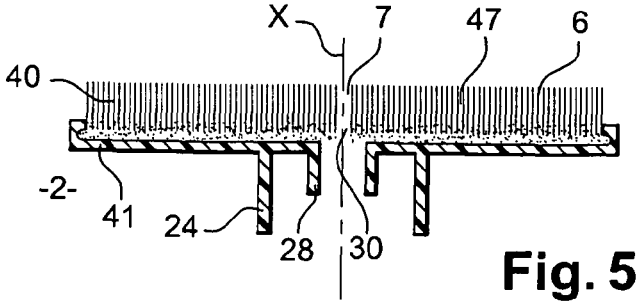

Alternatively, as shown in FIG. 5*e*, the application surface 6 can include a tuft of bristles 47 designed to be applied against the area of skin to be massaged. The massage element can then be used in the manner of a shaving brush to work up a foam with the product and/or spread the product on the face before shaving.

As a variant, when the purpose of the massage is to deep cleanse the skin, the application surface 6 can be abrasive, formed for example by incorporating particles of aluminium oxide in a resin or a foam.

Throughout the description, the expressions such as "including one," "having one," "has," "have," or "comprising" should be regarded as synonymous with "including at least one," unless otherwise specified.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for massaging and/or dispensing a product comprising:

a container that holds a cosmetic product;

a housing to which the container is mounted at a first end of the housing;

a massage element mounted on a second end of the housing, wherein the first end of the housing is located at an opposite end of the housing from the second end of the housing;

a rotary drive arrangement which rotates said massage element relative to the housing and the container about an axis of rotation; and a channel that extends through the housing from a first end that is connected to an outlet of the container at the first end of the housing to a second end that projects beyond the second end of the housing into a mounting skirt of the massage element so as to create fluid communication between the outlet of the container and an interior of the mounting skirt of the massage element, wherein the channel extends from the first end of the channel to the second end of the channel along an axis that is substantially coincident with the axis of rotation of the massage element, and wherein the channel is rotationally immobile relative to the housing;

wherein the container includes an axis extending between said outlet and a bottom of the container, and wherein said axis of said container is parallel to the axis of rotation.

2. A device according to claim 1, wherein the container is configured for the packaging and dispensing of a product under pressure, and wherein the channel is connected to an outlet of a dispensing valve on the container.

3. A device according to claim 2, wherein the container is arranged relative to the housing so as to provide a grasping element.

4. A device according to claim 2, further including an actuating element which actuates the valve, wherein said actuating element projects beyond an external outline of the housing.

5. A device according to claim 2, further including means for actuating the valve by pushing down a valve stem of the valve.

6. A device according to claim 1, wherein the container includes a principal lengthwise axis parallel to the axis of rotation of the massage element.

7. A device according to claim 1, wherein the container is detachably mounted on the housing.

8. A device according to claim 1, wherein the container is snap-fit in place in a cavity of the housing.

9. A device according to claim 2, wherein the container includes a wall delineating therein two compartments having variable volumes, said two compartments including a first compartment in communication with the valve and containing the product to be sprayed and a second compartment containing a propellant, and wherein the wall is impermeable to the product and the propellant.

10. A device according to claim 1, wherein the massage element is detachably mounted on the housing.

11. A device according to claim 1, wherein the massage element includes an application surface having at least one projection, which is off-center with respect to said axis of rotation.

12. A device according to claim 1, wherein the application surface includes a plurality of projections having different shapes and different heights.

13. A device according to claim 1, wherein the massage element includes a detachable head having an application surface thereon.

14. A device according to claim 1, wherein the massage element includes a foam pad designed to be applied against an area of skin to be massaged.

15. A device according to claim 1, wherein the massage element includes a tuft of bristles.

16. A device according to claim 1, wherein the massage element includes a structure holding freely rotatable balls seated in recesses in the massage element.

17. A device according to claim 1, wherein the massage element includes a resiliently deformable portion.

18. A device according to claim 1, wherein the massage element includes an abrasive application surface.

19. A device according to claim 18, wherein the abrasive application surface includes particles of aluminium oxide in a resin.

20. A device according to claim 1, wherein the massage element includes an application surface having a symmetry of revolution substantially about an axis of symmetry, wherein the application surface is rotated by the rotary drive arrangement about said axis of symmetry.

21. A device according to claim 1, wherein the rotary drive arrangement includes a motor.

22. A device according to claim 21, wherein the motor is powered by a battery, said battery including at least one cell accommodated in the housing.

23. A device according to claim 21, wherein the motor is powered by a power source external to said housing.

24. A device according to claim 18, wherein the motor is controlled by a control device associated with said housing.

25. A device according to claim 21, wherein the motor drives the massage element indirectly via a plurality of transmission elements.

26. A device according to claim 1, wherein the massage element is rotatably and detachably mounted on the housing.

27. An assembly including:

a as defined in claim 1;

wherein a plurality of containers are provided which are selectively and detachably mountable on the housing.

28. An assembly according to claim 27, wherein the containers hold different products.

29. An assembly according to claim 28, further including a plurality of massage elements which are selectively and detachably mountable on the housing.

30. An assembly according to claim 29, wherein the massage elements have different application surfaces.

31. A method of applying a cosmetic product on a surface of the body, including:

providing an assembly which includes a plurality of containers, a housing to which each of the plurality of containers is selectively and detachably mountable, a massage element mounted on the housing, a rotary drive arrangement which rotates the massage element relative to the housing about an axis of rotation, a channel that includes a first end that is connected an outlet of a container mounted on a first end of the housing and a second end that projects beyond a second end of the housing into a mounting skirt of the massage element so as to maintain fluid communication between the outlet of the container mounted on the housing and the massage element, that extends through the housing from the first end of the channel to the second end of the channel along an axis that is substantially coincident with the axis of rotation of the massage element, and that is rotationally immobile relative to the housing, and wherein an axis extending between the outlet of the container and a bottom of the container is parallel to said axis of rotation;

selecting a container from said plurality of containers;

mounting the selected container on the housing;

applying a product from the selected container onto the body; and massaging the area of the body onto which the product has been applied with the massage element driven in rotation.

32. A method according to claim 31, further including providing a plurality of massage elements which are selectively and detachably mountable to said housing, and selecting a massage element from said plurality of massage elements depending upon the container selected.

* * * * *

UNITED STATES PATENT AND TRADEMARK OFFICE

CERTIFICATE OF CORRECTION

PATENT NO. : 7,758,525 B2
APPLICATION NO. : 11/446121
DATED : July 20, 2010
INVENTOR(S) : Laure Thiebaut et al.

It is certified that error appears in the above-identified patent and that said Letters Patent is hereby corrected as shown below:

Column 10, line 42 (second line), insert the word --device-- before the word "as."

Signed and Sealed this

Sixteenth Day of November, 2010

David J. Kappos

David J. Kappos
*Director of the United States Patent and Trademark Office*